US010286542B2

(12) United States Patent
Wolle et al.

(10) Patent No.: US 10,286,542 B2
(45) **Date of Patent: *May 14, 2019**

(54) STORAGE CONTAINER

(71) Applicant: TTS Tooltechnic Systems AG & Co. KG, Wendlingen (DE)

(72) Inventors: Lutz Wolle, Burlafingen (DE); Markus Barabeisch, Vohringen (DE)

(73) Assignee: TTS TOOLTECHNIC SYSTEMS AG & CO. KG, Wendlingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/744,337

(22) PCT Filed: Jul. 24, 2015

(86) PCT No.: PCT/EP2015/066975

§ 371 (c)(1),
(2) Date: Jan. 12, 2018

(87) PCT Pub. No.: WO2017/016572

PCT Pub. Date: Feb. 2, 2017

(65) Prior Publication Data

US 2018/0200876 A1 Jul. 19, 2018

(51) Int. Cl.

| | |
|---|---|
| ***B25H 3/02*** | (2006.01) |
| ***B25H 3/06*** | (2006.01) |
| ***B65D 21/02*** | (2006.01) |

(52) U.S. Cl.

CPC ..... *B25H 3/028* (2013.01); *B25H 3/02* (2013.01); *B25H 3/06* (2013.01); *B65D 21/0212* (2013.01)

(58) Field of Classification Search

CPC ..... A47B 87/0207; A47B 87/0284; A47B 87/0276; B25H 3/028; B25H 3/02; B25H 3/06; B65D 21/0212

(Continued)

(56) References Cited

U.S. PATENT DOCUMENTS 984,784 A 2/1911 Tilton
3,003,839 A * 10/1961 Bloom ..... A47B 87/0207 206/512

(Continued)

FOREIGN PATENT DOCUMENTS

DE 202004020112 3/2005
DE 202009018589 5/2012

(Continued)

*Primary Examiner* — Janet M Wilkens
(74) *Attorney, Agent, or Firm* — Hoffman & Baron, LLP

(57) ABSTRACT

A storage container including a modular container housing that includes a plurality of housing modules which are placed on top of each other in a vertical direction and are coupled to each other in pairs. Housing modules that are placed immediately on top of each other jointly delimit a slot for an extractable and insertable tray element. Each of the housing modules has a horizontal module wall which runs transversely to the vertical direction and from which a lateral module wall extends upward. At least one slot is laterally delimited by a lateral slot wall which is composed of a combination of an upward-extending upper lateral module wall of a bottom housing module and a downward-extending lower lateral module wall of a top housing module that is placed on the bottom housing module, the lower lateral module wall being coupled to the aforementioned upper lateral module wall.

18 Claims, 9 Drawing Sheets

(58) Field of Classification Search
USPC ..... 220/4.26–4.28, 4.31, 4.33; 312/107, 108, 312/111, 330.1, 290
See application file for complete search history.

(56) References Cited

U.S. PATENT DOCUMENTS 3,203,744 A * 8/1965 Batke ..... A47B 47/04 312/108
3,316,045 A 4/1967 Leland
4,775,199 A * 10/1988 Lanius ..... B25H 3/028 312/216
5,016,946 A * 5/1991 Reznikov ..... A47B 87/02 312/108
5,399,006 A * 3/1995 Murazumi ..... A47B 87/0207 312/109
5,544,751 A 8/1996 Klodt et al.
5,603,559 A 2/1997 Yemini
5,667,287 A * 9/1997 Gunning ..... A47B 81/068 312/108
5,762,411 A * 6/1998 Yemini ..... B25H 3/003 206/372
6,736,265 B2 * 5/2004 Kipper ..... B25H 3/023 206/373
D517,805 S * 3/2006 Hosking ..... D3/291
7,100,999 B2 * 9/2006 Stravitz ..... A47B 87/008 312/108
7,712,621 B2 * 5/2010 Cho ..... H05K 5/0213 220/4.28
D803,561 S * 11/2017 Kuhls ..... D3/281
2002/0125159 A1 9/2002 Hann
2006/0033407 A1 * 2/2006 Su ..... A47B 87/02 312/111
2011/0233096 A1 * 9/2011 Michels ..... B65D 25/205 206/459.5
2012/0181904 A1 * 7/2012 Ma ..... A47B 67/04 312/108
2012/0326406 A1 * 12/2012 Lifshitz ..... B25H 3/02 280/47.19

FOREIGN PATENT DOCUMENTS

DE 102012107955 3/2014
EP 1658160 5/2008
WO 9612424 * 5/1996
WO 2017016573 * 2/2017
WO 2017016574 * 2/2017
WO 2017016581 * 2/2017

* cited by examiner

STORAGE CONTAINER

This application claims priority based on an International Application filed under the Patent Cooperation Treaty, PCT/EP2015/066975, filed Jul. 24, 2015.

BACKGROUND OF THE INVENTION

The invention relates to a storage container comprising a modular container housing which includes a plurality of housing modules which are placed on top of one another in a height direction and coupled to one another in pairs in a manner which prevents their being lifted off from one another, and which is provided with at least one reception compartment bounded by two housing modules placed immediately on top of one another and open at a front side of the container housing for a pull-out and push-in drawer element, wherein housing modules which together bound a reception compartment have a module horizontal wall extending transversely to the height direction and at least one module side wall projecting in the height direction and integrally formed at the edge of the module horizontal wall and are coupled to one another at their module side walls Such a storage container is known from EP 1 658 160 B1. This known storage container is, for example, composed of three housing modules placed on top of one another in a height direction and latched to one another in pairs. Housing modules which are adjacent to one another in the height direction in each case bound together a reception compartment which is open towards the front of the container housing and in which a drawer element is located in a pull-out and push-in arrangement. Apart from a cover which can be placed on top, the housing modules are uniform in design and have a U-shaped profiling if viewed from the front. Each reception compartment is laterally bounded by a compartment side wall of the container housing which is exclusively formed by the upper module side wall of the housing module located below the respective reception compartment. The housing module located between two reception compartments, which can be described as a housing intermediate module, also has a horizontally oriented module horizontal wall with an upper module side wall which exclusively extends upwards and is located on the left-hand and the right-hand side as well as on the rear side. In order to couple the housing modules in pairs, the module horizontal wall has to have a stepped contour in the transitional region to the module side wall, which increases the constructive effort involved and can adversely affect the usable cross-section of the adjacent reception compartments.

From U.S. Pat. No. 5,544,751, too, a storage container is known which comprises several housing modules sitting vertically on top of one another and latched to one another while bounding a reception compartment for drawer elements in pairs. Apart from a case-like upper housing module, all housing modules here have a U-shaped cross-section and a module horizontal wall acting as a base, from which a module side wall exclusively extends upwards, bounding the compartment side wall of the reception compartment located above only.

DE 10 2012 107 955 A1 discloses a container with a base wall, two left-hand and right-hand side walls and a rear wall, the arrangement offering the opportunity to stack several such containers on top of one another and latch them together. Each container can accommodate a pull-out drawer.

From U.S. Pat. No. 5,603,559, a storage container is known in the housing of which several pull-out drawers are arranged. Such a storage container is also disclosed in DE 20 2004 020 112 U1.

DE 20 2009 018 589 U1 discloses a container assembly composed if several stackable containers which can be coupled vertically by means of cabinet locks.

U.S. Pat. No. 3,316,045 and US 2002/0125159 A1 describe storage containers with a one-part carcass in which several drawers are arranged in a pull-out manner and which has an opening on the top side, which can be closed by means of a pivotably mounted cover plate.

SUMMARY OF THE INVENTION

The invention is based on the problem of creating a modular storage container which is suitable for accommodating at least two drawer elements and the housing modules of which, while being cost-effective in construction, can easily be coupled to one another.

To solve this problem, it is provided, in combination with the features mentioned above, that at least one or each reception compartment is laterally bounded by a compartment side wall of the container housing, which compartment side wall is composed of an upward-projecting upper module side wall of a lower housing module and a downward-projecting lower module side wall of an upper housing module placed on top of the lower housing module in the height direction, which downward-projecting lower module side wall is coupled to this upper module side wall in a way which prevents lifting-off.

The storage container according to the invention has a container housing which defines either only one reception compartment or several reception compartments located on top of one another in the height direction, each reception compartment having a compartment opening at the front side of the container housing, through which opening a drawer element placed in the reception compartment can be pulled out and pushed in again as required. The container housing has a modular structure with a plurality of housing modules sitting on top of one another and coupled in pairs, each reception compartment being bounded by two housing modules arranged immediately on top of one another. In at least one and preferably in all of the reception compartments, the module side wall is formed not only by one of the housing modules bounding the respective reception compartment, but together by both housing modules, being composed of an upward-projecting upper module side wall of the lower housing module and a downward-projecting lower module side wall of the housing module placed above. The mutual coupling of the housing modules is established at the upper and lower module side walls which together form a compartment side wall, which facilitates an optimum realisation of the required coupling devices, which can in particular be arranged such that that they do not affect the shaping of the module horizontal walls which bound the respective reception compartment above and below. This in turn facilitates an optimum utilisation of the volume of the respective reception compartment.

Advantageous further developments of the invention emerge from the dependent claims.

Among the housing modules of the modular container housing, there are preferably provided a lower housing end module which is located at the underside of the container housing and has an upward-projecting upper module side wall, as well as an upper housing end module which is located at the top side of the container housing and has a downward-projecting lower module side wall. A particularly compact storage container is provided with a single reception compartment which is jointly bounded by the upper housing end module and the lower housing end module, the compartment side wall of this single reception compartment being formed jointly from the upper module side wall of the lower housing end module and the lower housing side wall of the upper housing end module.

If the storage container is to have several reception compartments placed on top of one another, its container housing comprises, in addition to the upper housing end module and the lower housing end module, at least one further housing module located in between and described as housing intermediate module, so that both the upper housing end module and the lower housing end module define a reception compartment together with a housing intermediate module adjacent in the height direction.

In this, it is advantageous if the housing intermediate module has a module horizontal wall which extends transversely to the height direction of the container housing and is provided both with an upward-projecting upper module side wall and with a downward-projecting module side wall. These upper and lower module side walls are integrally joined to the module horizontal wall, and each of them can be coupled to a module side wall of an adjacent housing module. This adjacent housing module may be either a further housing intermediate module or an upper or lower housing end module.

On its top side, the upper housing end module, which completes the storage container at the top, is expediently bounded by a cover wall, on the upward-oriented outside of which a bow-shaped carrying handle is provided, preferably in a pivotable manner. The carrying handle is preferably arranged such that it can be pivoted between a position of non-use, in which it is pivoted towards the cover wall and in particular recessed into the cover wall, and a position of use, in which it is pivoted into an upright position. With the aid of the carrying handle, the storage container can easily be picked up and transported manually.

In an expedient embodiment of the storage container, the upper cover wall is directly represented by the upper end wall of the upper housing end module. In this case the upper housing end module has a single module horizontal wall which defines both the upper end wall and the cover wall.

In a likewise advantageous alternative embodiment, the upper housing end module is designed as a container module which bounds a storage space accessible through an access opening pointing upwards in the height direction, wherein the upper end wall of the upper housing end module forms a base wall of the container module and wherein a container module side wall which laterally bounds the storage space projects upwards in the height direction from the edge of this upper end wall. This offers the opportunity of using, in addition to the at least one drawer element, the container module defined by the container housing for storing objects as well. This extends the range of applications of the storage container.

In a possible variant, the access opening of the container module is always open. In order to prevent a contamination of the content of the storage space, it is, however, advantageous if the container module has a cover plate which optionally frees or blocks the access opening. This cover plate is either removable or preferably mounted pivotably on the container module side wall of the container. In this embodiment, the cover plate acts as a cover wall of the upper end module, this cover wall being arranged at a distance from the upper end wall of the upper housing end module.

Relative to the height direction of the container housing, the upper and lower module side walls, which together form a compartment side wall, can have the same wall height. With regard to the stability of the compartment side wall in particular, however, it has been found to be advantageous if the upper module side wall has in the height direction of the container housing a wall height which is different from the correspondingly measured wall height of the lower module side wall of the same housing module. An embodiment in which the upward-projecting upper module side wall is higher than the downward-projecting lower module side wall is particularly preferred. This preferred height ratio expediently also applies to optionally provided housing intermediate modules having both an upper and a lower module side wall.

If the storage container is provided with several housing intermediate modules, these housing intermediate modules are preferably designed identically.

The coupling which makes for the stable bond between the housing modules is for all pairs of adjacent housing modules expediently established between the upward-projecting upper module side wall of the lower housing module and the downward-projecting lower module side wall of the housing module located immediately above. These module side walls are provided with coupling means, in particular in the form of latching means, to effect the coupling. The coupling means are preferably located at the vertically oriented end faces of the module side walls.

For mutual coupling, the housing modules of the container housing are expediently latched to one another by mutually engaging latching means. To reduce costs, it is recommended that the cooperating latching means be designed such that the latching connection, once established, cannot be released, giving the container housing the character of a monolithic body in terms of stability irrespective of its modular structure. The coupling measures may, however, be designed to be releasable as well.

For coupling by means of a latching connection, it is expediently provided that each upward-projecting upper module side wall has several first latching means and each downward-projecting lower module side wall has a corresponding number of second latching means which complement the first latching means. Either the first latching means or the second latching means are preferably designed as latching hooks which extend away from the associated module side wall in the height direction and engage a latching edge of the other latching means from behind in the latched state provided for coupling. In the latched state, the mutually assigned upper and lower module side walls of adjacent housing modules are expediently supported on one another by their vertically oriented end faces and are there expediently clamped to one another in the height direction of the container housing by the positively cooperating latching means.

Each latching hook expediently dips into a plug-in receptacle which is formed on the adjacent housing module and open in the height direction on at least one side, and to which the latching edge mentioned above is assigned. The plug-in receptacle is expediently bounded by a lateral boundary wall in which at least one window-type opening is formed, its rim forming the latching edge.

If the container housing has a rectangular outline, which is the preferred shape, each of the upper and lower side walls has two opposite left-hand and right-hand lateral wall sections and a rear wall section bounding the reception compartment at the rear, i.e. opposite the front compartment opening. The latching means are preferably provided exclusively at the lateral wall sections.

The module side walls can be partially broken, in particular for providing a view of the interior of the associated reception compartment. It is, however, deemed to be more advantageous if each compartment side wall, apart from the compartment opening provided at the front, extends as a closed entity around the associated reception compartment.

The storage container expediently comprises a number of drawer elements which at least corresponds to the number of reception compartments. The drawer elements, if several are provided, are independently located in their own reception compartments in a pull-out and push-in arrangement. It is expediently possible to pull each drawer element completely out of the associated reception compartment and to remove it from the container housing.

The storage container is preferably designed to be portable. For easy transport, it is expediently provided, as mentioned above, with at least one carrying handle which is preferably located on the top of the container housing. During transport, the drawer elements are expediently pushed fully into the associated reception compartments. Locking means are preferably provided for releasably locking each drawer element to the housing in its fully pushed-in position.

Each drawer element expediently has a base wall and an outer wall which extends around the edge of the base wall and projects upwards. Together with the outer wall, the base wall bounds a drawer interior which can be used for storing any objects, such as tools or ironmongery. The drawer interior can be divided into several interior sections by one or more partitions. For ease of handling when pulling out and pushing in, each drawer element expediently has a handle on the outside—remote from the drawer interior—of a front outer wall section of the drawer element.

The drawer element is preferably designed without a cover. It is, however, easily possible to provide the drawer element with a removable or pivotable cover for covering the drawer interior at the top. In this case, the drawer element can itself be designed in the manner of a container, for example as a small shell case.

BRIEF DESCRIPTION OF THE DRAWINGS

The invention is explained in greater detail below with reference to the accompanying drawing, of which.

DETAILED DESCRIPTION OF THE PREFERRED EMBODIMENTS

Figure 1:
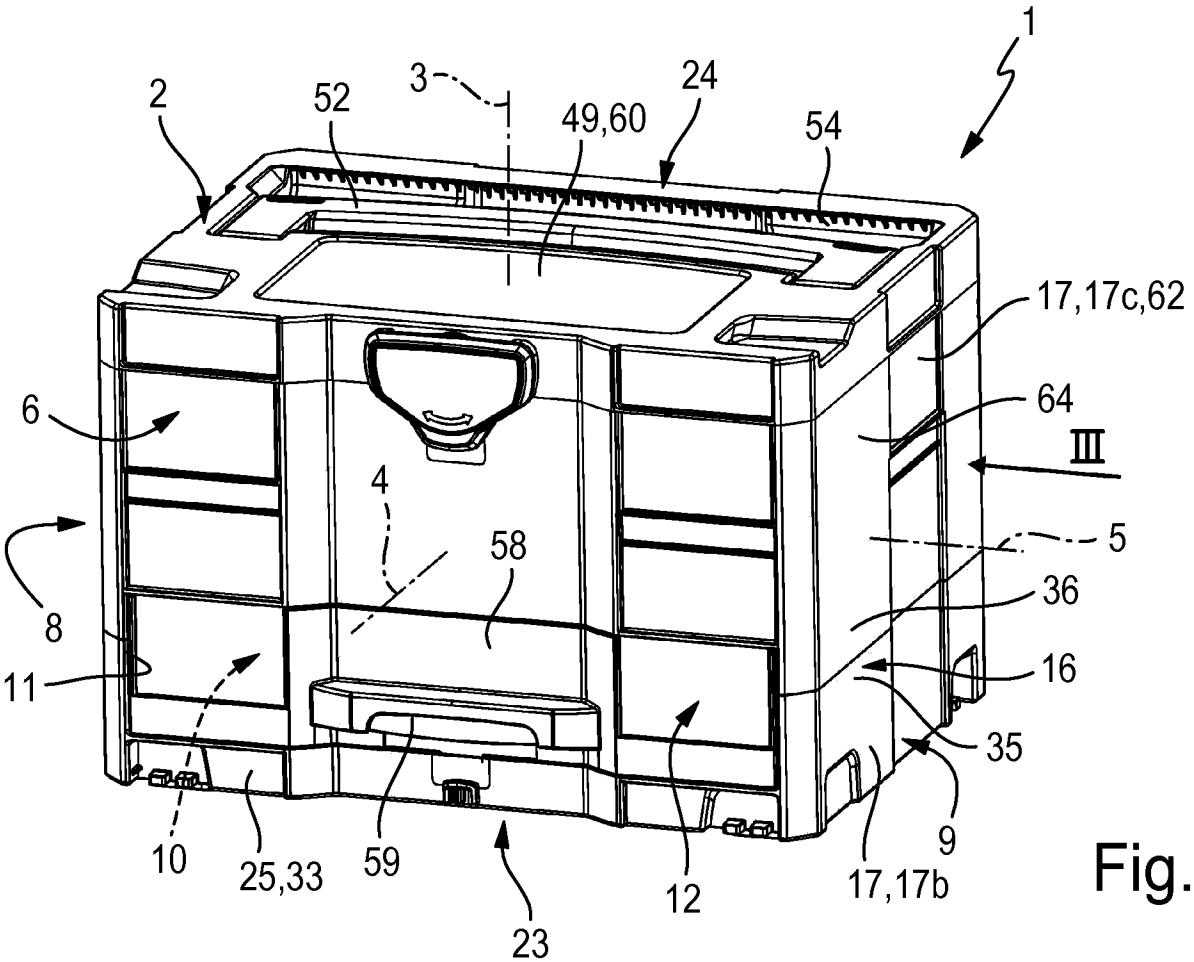
FIG. 1 shows a preferred embodiment of the storage container according to the invention in a variant with only two housing modules which jointly bound a reception compartment fitted with a drawer element, wherein the upper housing module is designed as a container module with a pivotable cover plate.
Figure 2:
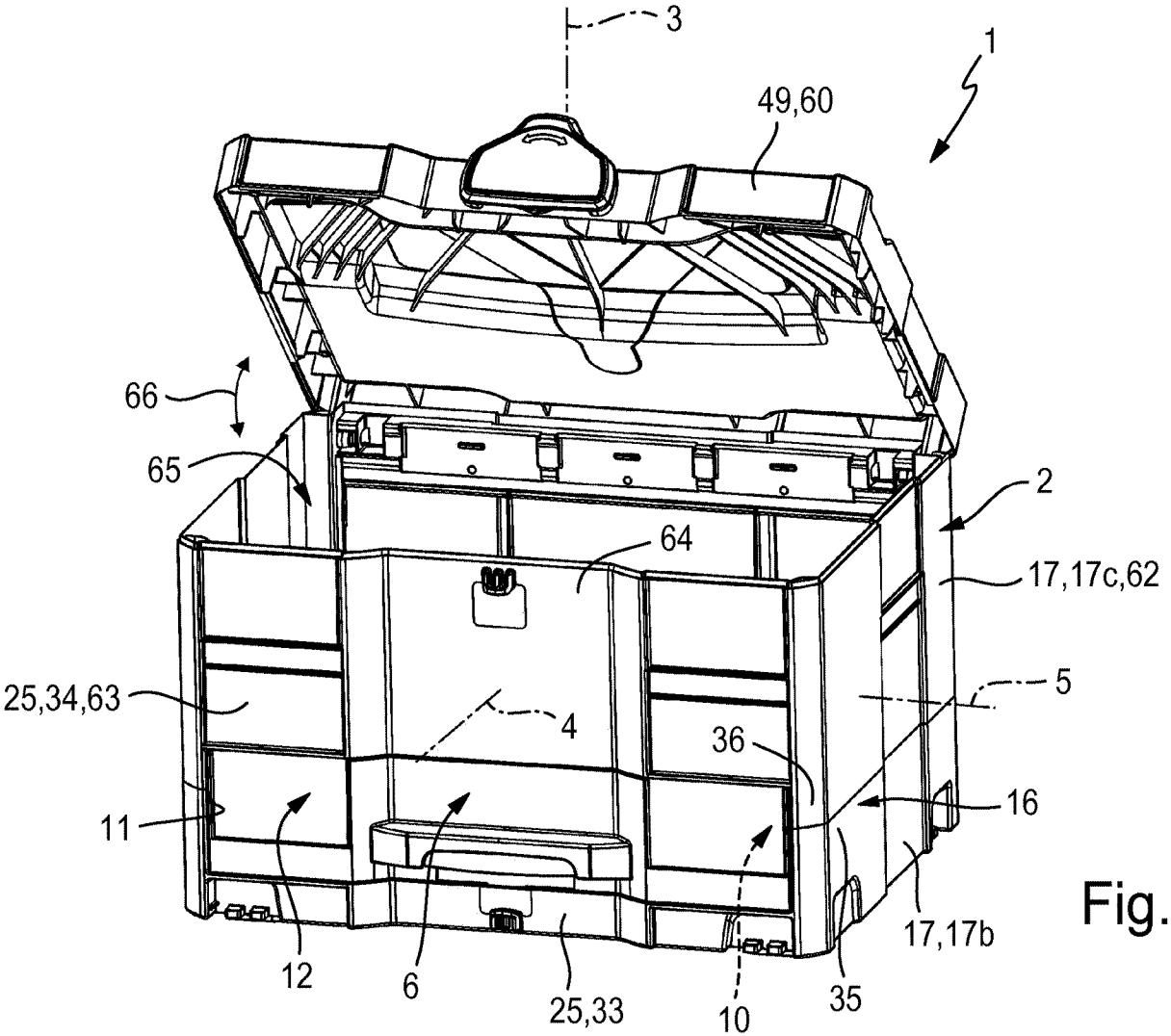
FIG. 2 shows the storage container from FIG. 1 with its cover plate pivoted upwards into an open position.

The storage container, which is identified by the reference number 1 in its entirety, has a container housing 2 with a vertical axis 3, the axial direction of the vertical axis 3 being hereinafter also referred to as the height direction 3.

The container housing 2 further has a longitudinal axis 4 perpendicular to the vertical axis 3 and a transverse axis 5 perpendicular to the vertical axis 3 and the longitudinal axis 4. The axial direction of the longitudinal axis 4 defines a depth direction, and the axial direction of the transverse axis 5 defines a width direction of the container housing 2.

In the usual position of use of the storage container, the vertical axis 3 is oriented vertically.

In a plane perpendicular to the vertical axis 3 the container housing 2 preferably has an at least substantially rectangular outline. As a whole, the container housing 2 preferably has a cuboid basic structure.

The container housing 2 has a front side 6 oriented in the axial direction of the longitudinal axis 4 and a rear side 7 opposite the former. The container housing 2 further has two lateral outsides 8, 9 arranged opposite each other and oriented in the axial direction of the transverse axis 5.

Figure 8:
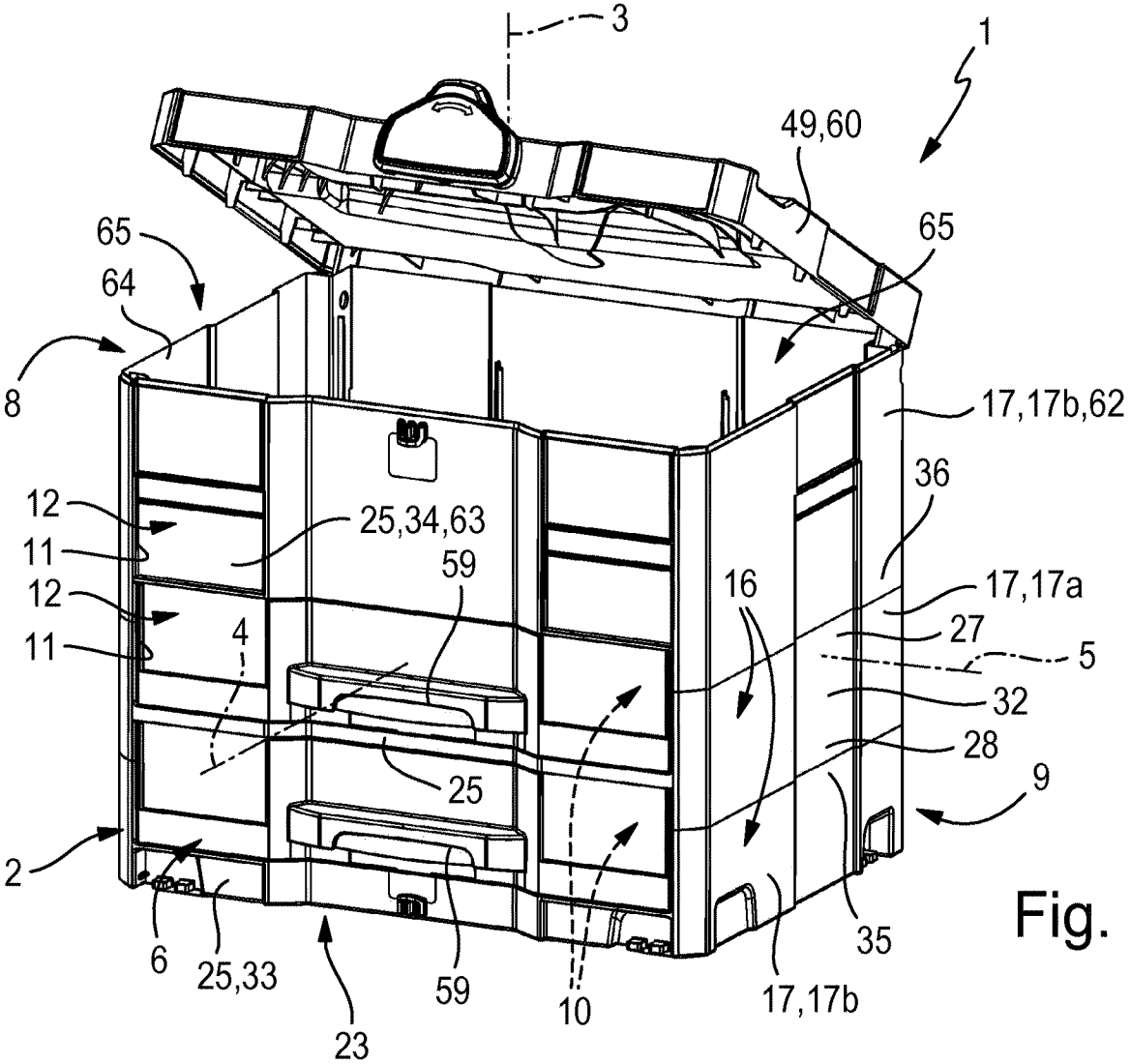
FIG. 8 shows a further embodiment of the storage container with a container module at the top and with two reception compartments for a drawer element each.
Figure 9:
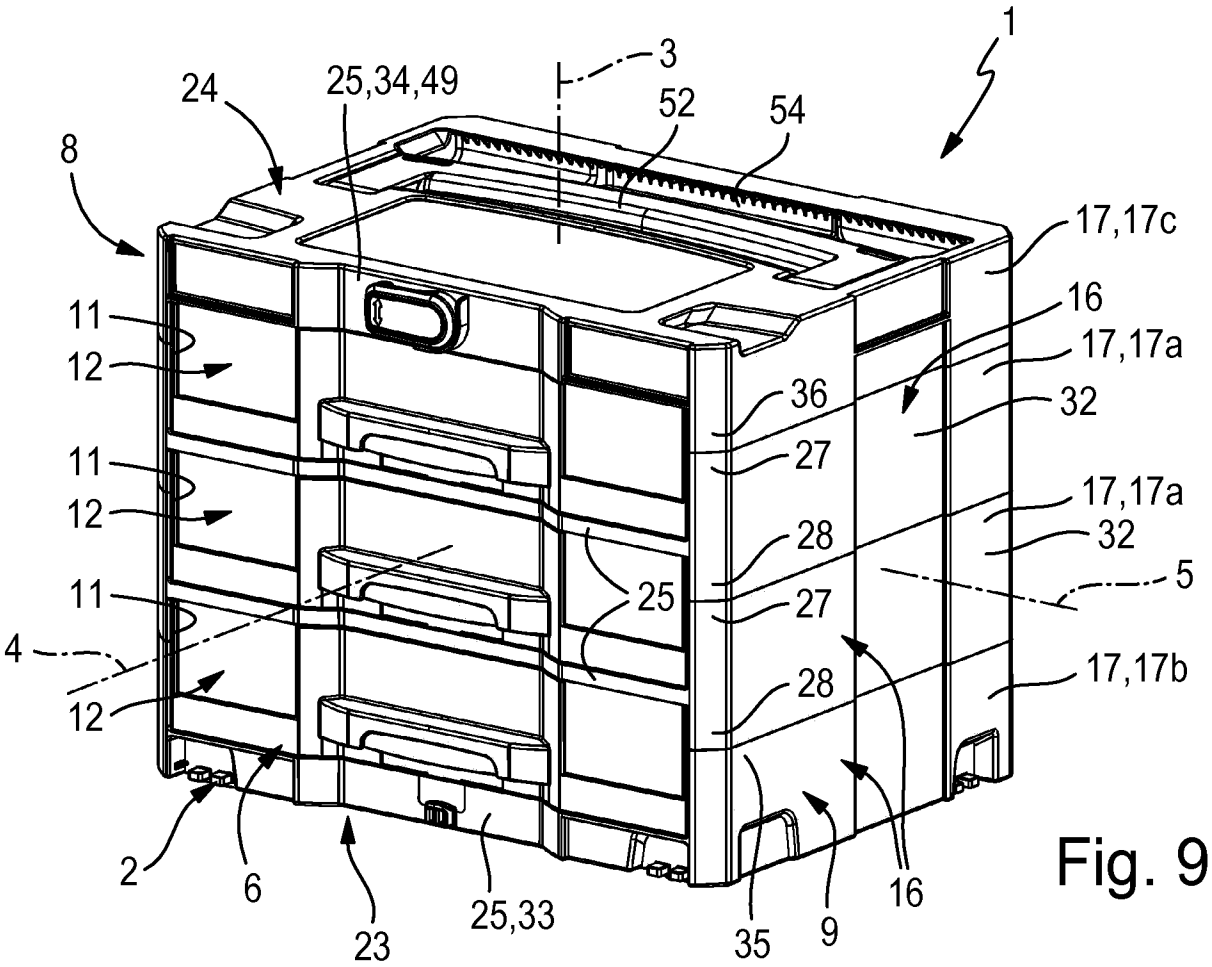
FIG. 9 shows a further embodiment of the storage container with a total of three reception compartments accommodating a drawer element each.
Figure 10:
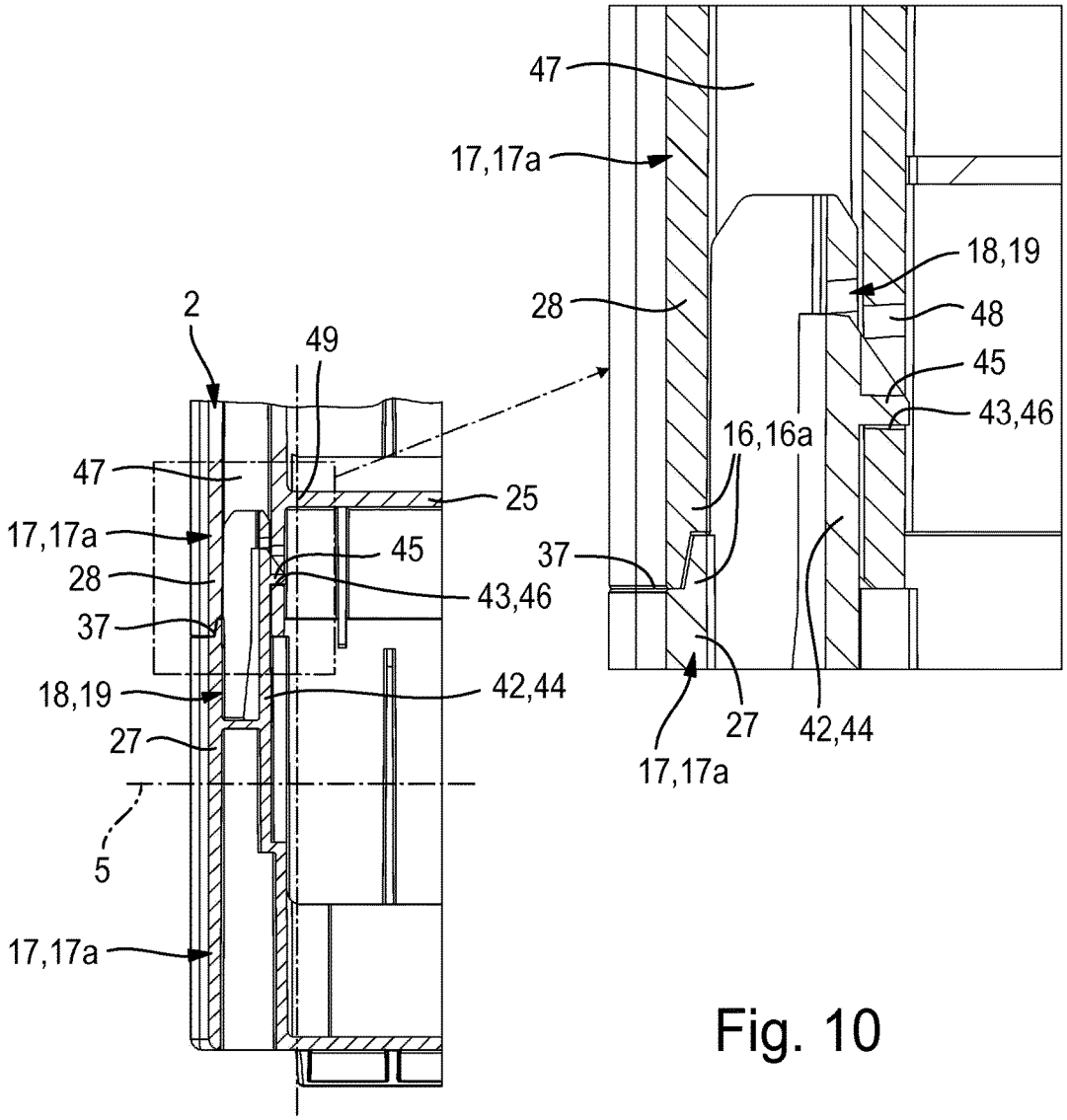
FIG. 10 is a vertical section of the storage container from FIGS. 4 and 7, limited to the lateral wall region of the container housing indicated by "X", in order to illustrate the latching connections providing the coupling of the modules, a framed section of FIG. 10 being shown separately in an enlargement.

The container housing 2 bounds at least one reception compartment 10 for a drawer element 12. Depending on the variant, the container housing 2 contains only a single reception compartment 10—this applies to the embodiments of FIGS. 1 to 7—or a plurality of reception compartments 10 arranged on top of one another in the height direction 3. The latter is the case in the embodiments of FIGS. 8 and 9, with two reception compartments 10 as shown in FIG. 8 or three reception compartments 10 as shown in FIG. 9 being formed on top of one another in the container housing 2. In principle, any number of compartments can be provided, depending on the need for storage facilities.

Each reception compartment 10 is accessible from the outside through its own compartment opening 11 located on the front side 6 and cut out of the container housing 2. In each reception compartment 10, a drawer element 12 is located; within an operating movement 13 indicated by a double-headed arrow and oriented in the axial direction of the longitudinal axis 4, this can optionally be pulled out of the associated reception compartment 10 or pushed into the respective reception compartment 10.

Figure 3:
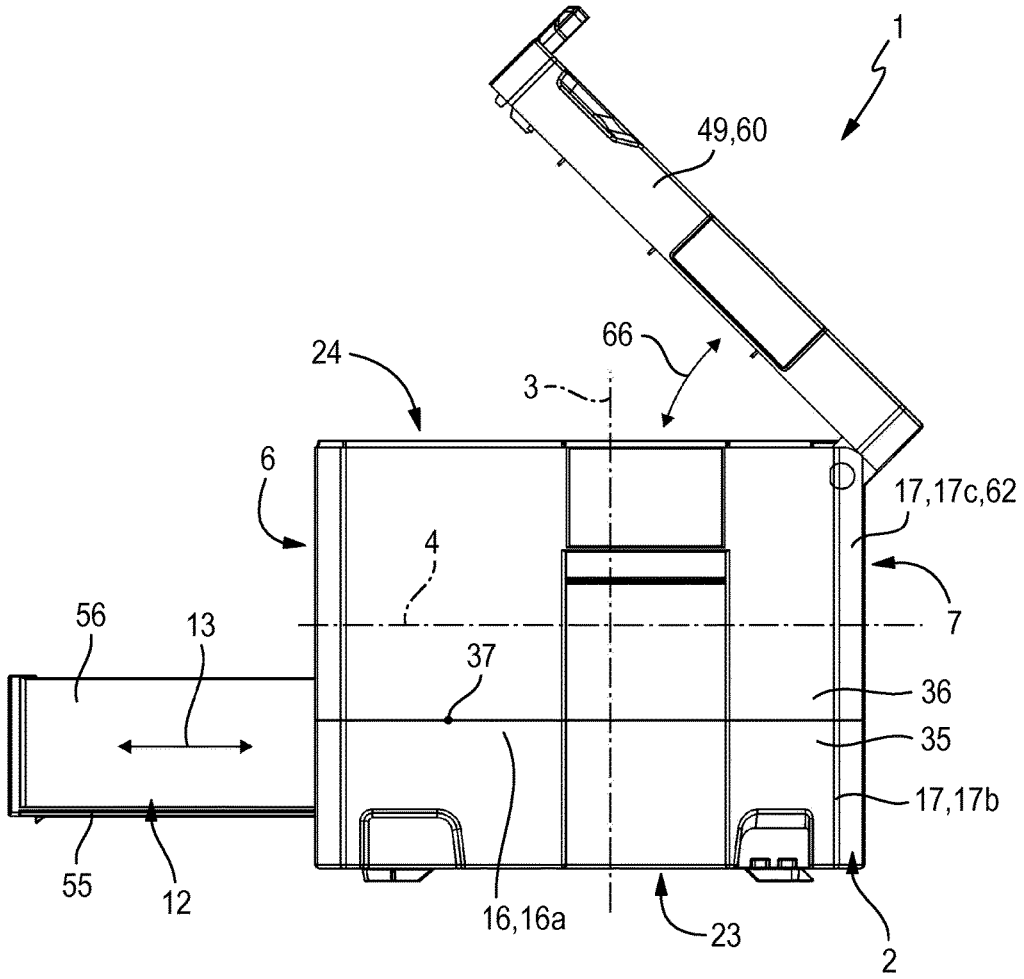
FIG. 3 is a side view of the storage container from FIGS. 1 and 2 in the direction of arrow III in FIG. 1, wherein the cover plate is pivoted upwards into an open position and the drawer element has been pulled out of the associated reception compartment to some degree.
Figure 4:
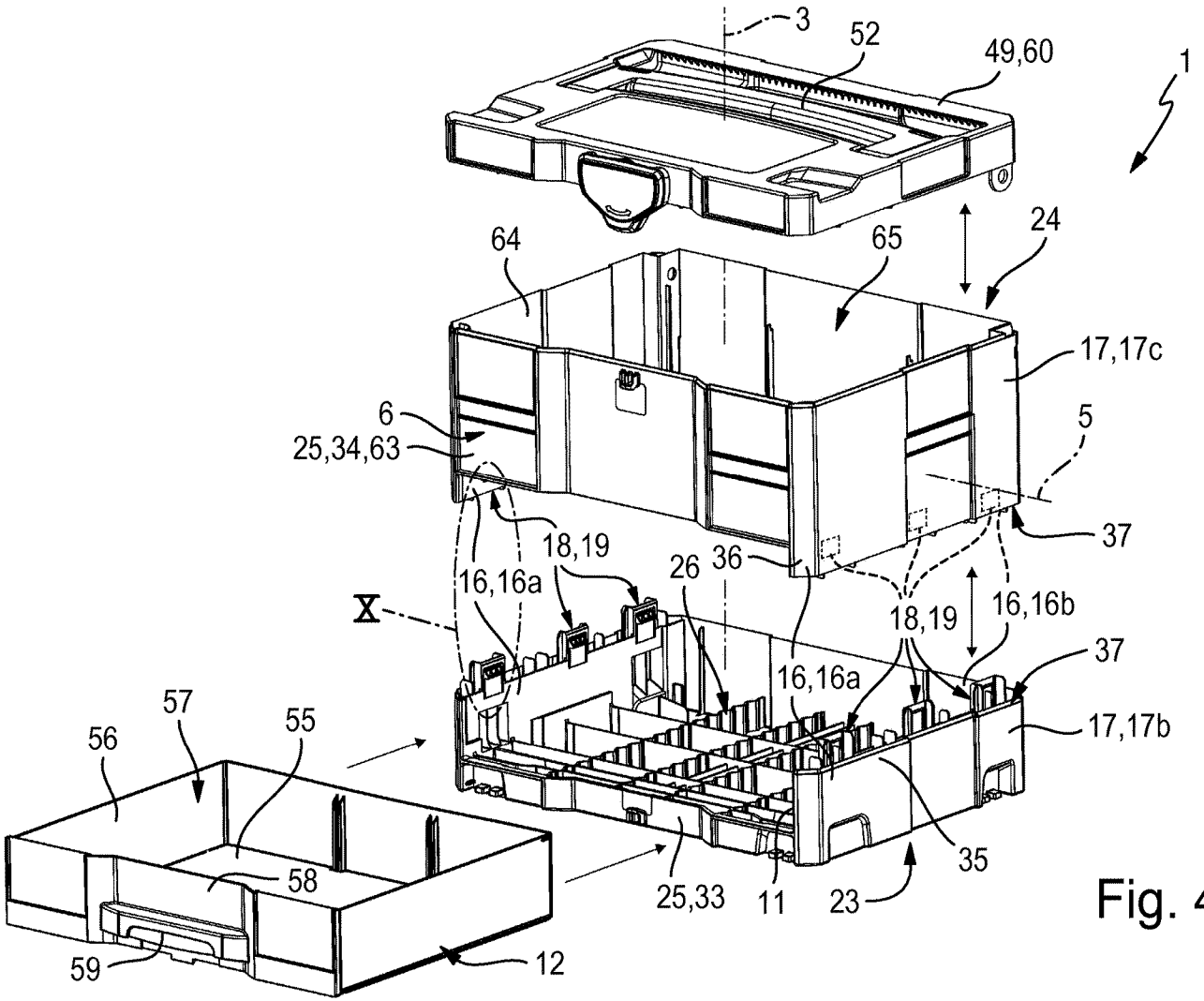
FIG. 4 is an exploded view of the storage container from FIGS. 1 to 3.
Figure 5:
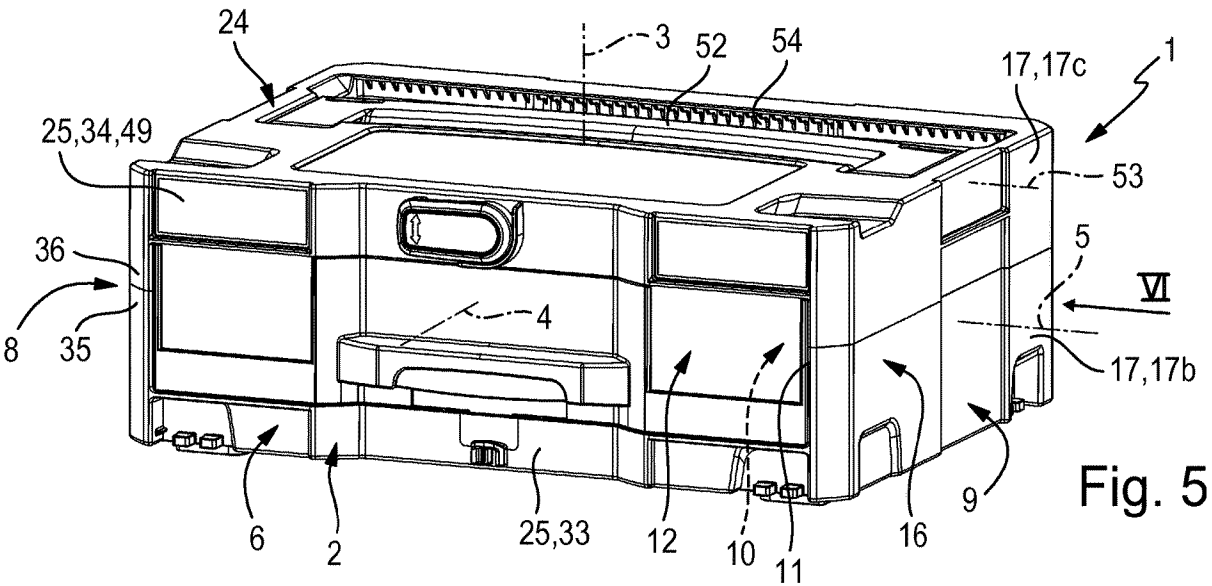
FIG. 5 shows a further embodiment of the storage container, wherein the container housing is again composed of only two mutually coupled and in particular latched housing modules which together define a single reception compartment, the upper end wall of the upper end module, which bounds the reception compartment, simultaneously forming the cover wall—provided with a carrying handle—of the container housing.
Figure 6:
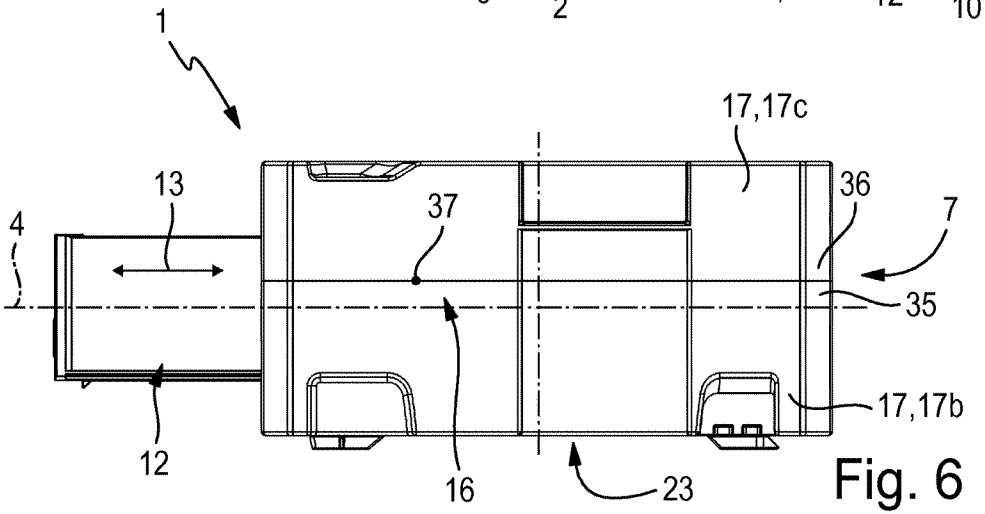
FIG. 6 is a side view of the storage container from FIG. 5 in the direction of arrow VI from FIG. 5.
Figure 7:
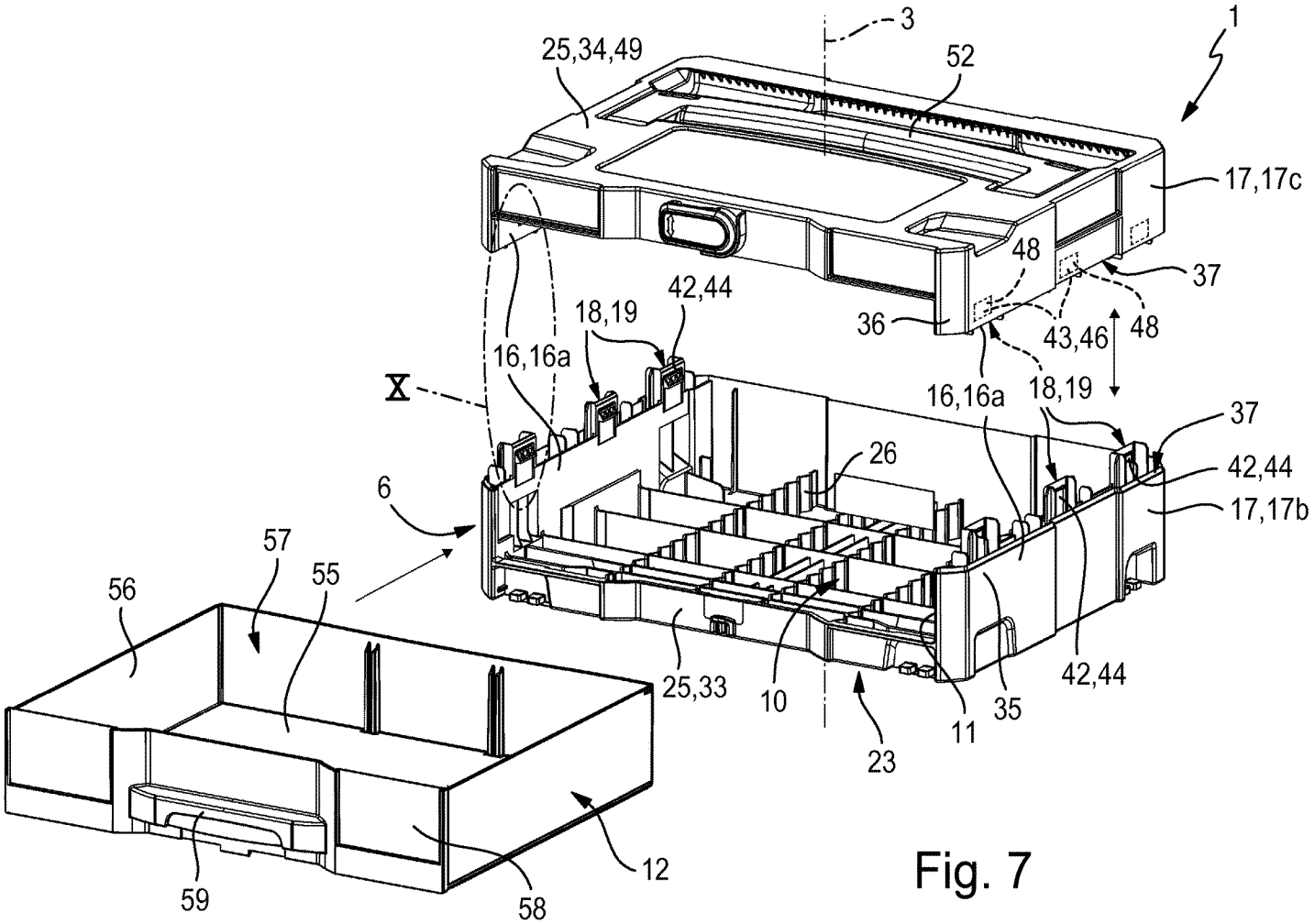
FIG. 7 is an exploded view of the storage container shown in FIGS. 5 and 6.

In FIGS. 1, 2, 5, 8 and 9, the drawer elements 12 are shown in the home position pushed into the associated reception compartment 10. FIGS. 3 and 6 each shows a position of use of the storage container 1 with drawer element 12 being partially pulled out of the associated reception compartment 10.

For each reception compartment 10, the container housing 2 forms a compartment side wall 16, which bounds the associated reception compartment 10 at the sides oriented at right angles to the vertical axis 3—with the exception of the region of the compartment opening 11. Apart from the compartment opening 11 facilitating access to the drawer element 12, each compartment side wall 16 preferably extends as a closed wall around the associated reception compartment 10.

Accordingly, each compartment side wall 16 has two lateral compartment side wall sections 16*a* assigned to the lateral outsides 8, 9 and a rear compartment side wall section 16*b* located on the rear opposite the compartment opening 11. The rear compartment side wall section 16*b* can be dispensed with at least partially, so that the drawer element 12 remains visible from the rear side 7 in the associated reception compartment 10.

The container housing 2 is constructed in a modular manner and composed of a plurality of housing modules 17, which are arranged on top of one another in the axial direction of the vertical axis 3 and sit on top of one another. Housing modules 17 which are immediately adjacent to one another in the height direction 3 are coupled to one another in such a way that relative movement is impossible in any spatial direction. This being so, the coupled housing modules 17 can neither be displaced relative to one another in a horizontal plane extending at right angles to the vertical axis 3 nor lifted off one another in the height direction 3.

The responsibility for the cohesion of the module assembly lies with coupling devices 18 provided between housing modules 17 which are adjacent to one another in the vertical direction 3. As in the illustrated embodiment, these are preferably designed as latching connection devices 19. During the assembly of the container housing 2, the housing modules 17 can be placed on top of one another in the height direction 3 and partially plugged into one another by applying a defined actuating force, thereby being latched to one another. The latching connection devices 19 are preferably non-releasable, so that an unintentional breaking up of the module assembly can be reliably excluded. In principle, however, it would be possible to design the coupling devices 18 in a manner which allows their decoupling.

Housing modules 17 which are arranged directly on top of one another in the height direction 3 of the container housing 2 together bound one of the reception compartments 10 each. Such housing modules 17 which bound both a reception compartment 10 placed above and a reception compartment 10 placed below shall be described as housing intermediate modules 17*a*.

In the region of its underside 23 pointing downwards relative to the axial direction of the vertical axis 3, the container housing 2 has a housing module 17 described as lower housing end module 17*b*. In the region of the opposite top side 24, the container housing 2 has a housing module 17 described as upper housing end module 17*c*.

In order to define more than one reception compartment 10, the container housing 2 comprises at least one housing intermediate module 17*a*. To obtain precisely two reception compartments 10 (FIG. 8), it comprises precisely one housing intermediate module 17*a*. For each further reception compartment 10, a further housing intermediate module 17*a* is added, so that the embodiment of FIG. 9 is provided with two housing intermediate modules 17*a* for three reception compartments.

Together with the lower housing end module 17*b*, the lowermost housing intermediate modules 17*a* bounds a lowermost reception compartment 10, while the topmost housing intermediate modules 17*a* bounds a topmost reception compartment 10 with the upper housing end module 17*c*.

If the storage container 1 has only one housing intermediate module 17*a*, this, together with the lower housing end module 17*b*, bounds the lower of two reception compartments 10 and, together with the upper housing end module 17*c*, the upper of the two reception compartments 10.

If only one reception compartment 10 is required, no housing intermediate module 17*a* is provided. In this case, which is represented by the embodiments of FIGS. 1 to 7, the lower housing end module 17*b* and the upper housing end module 17*c* are directly coupled to each other and the single reception compartment 10 lies directly between lower housing end module 17*b* and the upper housing end module 17*c*.

Each housing module 17 has a module horizontal wall 25, which extends transversely and in particular at right angles to the vertical axis 3. This module horizontal wall 25 forms in each housing intermediate module 17*a* the base of the reception compartment 10 placed above and at the same time the ceiling of the reception compartment 10 placed below. In the lower housing end module 17*b*, the module horizontal wall 25 forms a lower end wall 33 of the adjacent reception compartment 10, and in the upper housing end module 17*c*, the module horizontal wall 25 forms an upper end wall 34 of the adjacent reception compartment 10. The module horizontal wall 25 is preferably designed to be plate-shaped, being expediently continuous. For stiffening, in particular, it can however be provided with integral ribbing 26 at the top side and/or the underside.

The module horizontal wall 25 expediently has an at least substantially rectangular outline, approximately in accordance with the outline of the container housing 2.

At the edges, two module side walls designated hereinafter as upper module side wall 27 and as lower module side wall 28 for easier differentiation are integrally formed on the module horizontal wall 25 of at least one and preferably of each housing intermediate module 17*a*. The upper module side wall 27 projects upwards in the height direction 3 from the outer edge of the module horizontal wall 25, while the lower module side wall 28 projects downwards in the height direction 3 from this outer edge 29.

The upper module side wall 27 preferably merges directly and integrally into the lower module side wall 28 of the same housing intermediate module 17*a*. The transition is gapless and without a break, in particular at the outer surface of the module side walls 27, 28 which are remote from the reception compartments 10. It is advantageous if the housing intermediate module 17*a* is designed such that the upper module side wall 27 and the lower module side wall 28 are wall sections of a one-piece intermediate module side wall 32, which projects from the module horizontal wall 25 both in the upward and in the downward direction, said wall sections directly merging into one another in the axial direction of the vertical axis 3. With its outer edge 29, the module horizontal wall 25 is integrally formed on the inner surface of the intermediate module side wall 32.

From the outer edge of the lower end wall 33 of the lower housing end module 17*b*, an upper module side wall 35 projects upwards in the height direction 3. In a comparable way, a lower module side wall 36 projects downwards from the outer edge of the upper module end wall 34, its circumferential shape corresponding to that of the upper module side wall 35 of the lower end wall 33. If a housing intermediate module 17*a* is provided, its intermediate module side wall 32 also has the sane circumferential shape as the upper module side wall 35 and the lower module side wall 36.

In the assembled state of the container housing 2, the upper module side wall 35 of the lower housing end module 17*b* is supported in the axial direction of the vertical axis 3 on the downward-oriented end face 37 of the lower module side wall 28 or 34 of the housing end module 17*c* or of the housing intermediate module 17*a* placed above. In a comparable way, the lower module side wall 36 of the upper housing end module 17*c* is supported with its downward-oriented end face 37 on the upward-oriented end face 37 of the upper module side wall 27 of the lower housing end module 17*b* or the housing intermediate module 17*a* placed immediately below.

The paired coupling between housing modules 17 arranged on top of one another is in each case established between the lower module side wall 36, 28 of the upper housing module 17 and the upper module side wall 35, 27 of the housing module 17 placed below. The coupling is established by means of the coupling devices 18 mentioned above, which are preferably designed as latching connection devices 19.

The reception compartment 10 bounded by the lower housing end module 17*b* is laterally bounded by a compartment side wall 16 composed of the upper module side wall 35 of the lower housing end module 17*b* and the lower module side wall 36 of the housing module 17 placed above, the latter being either the upper housing end module 17*c* or a housing intermediate module 17*a*.

The reception compartment 10 bounded by the upper housing end module 17*c* is laterally bounded by a compartment side wall 16 composed of the lower module side wall 36 of the upper housing end module 17*c* and the upper module side wall 35 of the housing module 17 placed below, the latter being either the lower housing end module 17*b* or a housing intermediate module 17*a*.

If the storage container 1 is provided with at least one housing intermediate module 17*a*, its intermediate module side wall 32 simultaneously forms a part of two compartment side walls 16, these being both the compartment side wall 16 of the reception compartment 10 located above the housing intermediate module 17*a* and the compartment side wall 16 of the of the reception compartment 10 located immediately below the housing intermediate module 17*a*. In other words, the housing intermediate module 17*a* contributes with its upper module side wall 27 and its lower module side wall 28 to the formation of the compartment side walls 16 of the reception compartments 10 located above and below the housing intermediate module 17*a*.

To enable the compartment side wall 16 to laterally close off the associated reception compartment 10 completely irrespective of the multi-part construction in the height direction 3, the housing modules 17 adjoining the housing intermediate module 17*a* at the top and at the bottom in the height direction 3 are preferably in full contact with the end face—oriented in the axial direction of the vertical axis 3—of the respectively associated module side wall 27, 28.

If the storage container 1 comprises several housing intermediate modules 17*a* arranged on top of one another in the vertical direction 3, the respective reception compartment 10 located between two housing intermediate modules 17*a* arranged on top of one another is laterally bounded by a compartment side wall 16 composed of the upward-projecting upper module side wall 27 of the lower housing intermediate module 17*a* and the downward-projecting lower module side wall 28 of the housing intermediate module 17*a* located immediately above.

In principle, the upper and lower module side walls 27, 35; 28, 36, which together define a compartment side wall 16, can have the same wall height as measured in the height direction 3 of the container housing 2. However, a design realised in all embodiments, in which the upper and lower module side walls 27, 35; 28, 36 have different wall heights, is preferred, so that they project to different degrees from the associated module horizontal wall 25 in the height direction 3 of the container housing 2.

The upper module side wall 27, 35 is preferably higher than the downward-projecting lower module side wall 28, 36.

All upper module side walls 27, 35 preferably have one and the same wall height, and all lower module side walls 28, 36 preferably have one and the same wall height as well.

Housing modules 17 arranged directly on top of one another in the height direction 3 are preferably coupled to one another at their facing upper and lower side walls 27, 28, 35, 36. The coupling is preferably established in the region of the vertically oriented end faces 37 of the module side walls 27, 28, 35, 36. In any case, the housing modules 17 vertically contact one another in such a way that they support one another by their facing end faces 37 in the height direction 3. The coupling devices 18 are preferably designed such that they clamp the contacting upper and lower module side walls 27, 28, 35, 36 together at their facing end faces 37.

In the illustrated storage containers 1, latching connection devices 19 of a particularly advantageous design are provided for the paired coupling of housing modules 17 which are adjacent in the height direction 3. These are described below.

To implement the latching connection devices 19, each upper module side wall 27, 35 has a plurality of first latching means 42 arranged at a distance from one another in the circumferential direction of the respective module side wall 27, 35, while each lower module side wall 28, 36 has a corresponding number of second latching means 43 distributed in the same way. The term "circumferential direction" of the module side wall denotes the direction around the vertical axis 3. As adjacent housing modules 17 are fitted to one another, the first and the second latching means 42, 43 engage with one another in pairs and form a latching interconnection which has the effect that the upper and lower module side walls 27, 28 are clamped to one another in the height direction 3.

The first and the second latching means 42, 43 are expediently provided only on those sections of the module side walls 27, 28, 35, 36 which form the two lateral compartment side wall sections 16*a*.

The first latching means 42 are expediently designed as latching hooks 44, which project upwards in the height direction 3 and support a latching projection 45, which protrudes at right angles to the vertical axis 3 and in particular extends towards the interior of the associated reception compartment 10.

The second latching means 43 on the lower module side wall 28 in each case consist of a latching edge 46 pointing upwards in the height direction 3. In the latched state, each latching edge 46 is overlapped by one of the latching projections 45 on the top side, so that a positive engagement ensues in the height direction 3 of the container housing 2.

The lower module side wall 28, 36 provided with the latching edge 46 is preferably at least partially hollow and defines at least one plug-in receptacle 47 which is open in the downward direction towards the adjacent upper module side wall 27. The associated latching hook 44 dips into this plug-in receptacle 47.

In each of its two wall sections contributing to the formation of the lateral compartment side wall sections 16*a*, the lower module side wall 28, 36 preferably has a groove-like plug-in receptacle 44, which extends in the axial direction of the longitudinal axis 4 and into which all of the associated latching hooks 44 dip together.

Each latching edge 46 is expediently represented by the edge of a window-type opening 48, which is formed in the lower module side wall 28, 36 and laterally opens into the plug-in receptacle 47. This window-type opening 48 is expediently provided in a lateral boundary wall 50 of the plug-in receptacle 44, which is assigned to the interior of the reception compartment 10 and belongs to the lower module side wall 28, 36.

The upper module side wall 27, 35 and/or the lower module side wall 28, 36 is/are preferably double-walled at least in the region of the coupling devices 18. The above-mentioned boundary wall 50 is preferably represented by the inner wall section of the double-walled module side wall 27, 35, 28, 36, which bounds the reception compartment 10 located at the same level. The plug-in receptacle 44 is preferably represented by the interior of the double-walled structure.

Concerning the latching connection devices 19, it should be said that the first and the second latching means 42, 43 can also be interchanged in terms of their mounting on the upper module side wall 27, 35 and the lower module side wall 28, 36.

On its top side, the upper housing end module 17*c* is expediently bounded by a cover wall 49, on the upward-oriented outside of which is provided a bow-shaped carrying handle 52, which can be gripped with one hand for transporting the storage container 1. The carrying handle 52 is expediently mounted pivotably on the cover wall 49, the pivot axis 53 preferably extending in the width direction of the container housing 2.

The carrying handle 52 can preferably be folded to the cover wall 49 into a position of non-use, in which it expediently comes to lie in a surface recess 54 of the cover wall 49. For use, the carrying handle 52 can be swivelled into an upright position of use.

In the embodiments of FIGS. 4 to 7 and FIG. 9, the upper end wall 34 and the cover wall 49 are one and the same component of the top housing end module 17*c*.

In the embodiments of FIGS. 1 to 3 and FIG. 8, the cover wall 49 is provided in addition to the upper end wall 34 and placed above the latter in the height direction 3, acting as a cover plate of an upper housing end module 17*c* designed as a container module 62.

The container module 62 has a base wall 63 represented by the upper end wall 34 of the upper housing end module 17*c*. From the edge of this base wall 63, a container module side wall 64 projects upwards, laterally bounding a storage space 65 with an access opening at the top for access for loading and unloading.

The above-mentioned cover plate 60, which is assigned to the access opening and facilitates its optional release or closure, also belongs to the container module 62. The cover plate 60 is expediently mounted pivotably as indicated by the double-headed arrow 66 on the container module side wall 64. The container module 62 can also be designed without a cover lid 60.

Each of the drawer elements 12 expediently has a base wall 55, which is preferably plate-shaped. Around the edge of the base wall 55, there extends an outer wall 56, which projects upwards in the axial direction of the vertical axis 3 and, together with the base wall 55, bounds a drawer interior 57 for storing objects. If the drawer element 12 is at least partially pulled out of the associated receptacle compartment 10 at the front side 6 of the container housing 2, the drawer interior 57 is open towards the top and accessible for placing or removing objects.

The drawer interior 57 can be divided into individual interior sections by means of partitions not illustrated in detail. In addition, the drawer element 12 can have a removable or a pivotably mounted cover.

On the outside—facing away from the drawer interior 57—of a front outer wall section 58 of the drawer element 12, which lies in the region of the compartment opening 11 in the pushed-in state, there is expediently provided a handle 59, on which the drawer element 12 can be gripped to pull it out of or to push it back into the drawer element 12.

The housing modules 17 and the drawer elements 12 expediently consist of a plastic material.

The invention claimed is:

1. A storage container provided with a modular container housing, which has a plurality of housing modules arranged above one another in a height direction and coupled to one another in pairs in a way which prevents their lifting off from one another and which is provided with at least one reception compartment bounded by two housing modules located directly above one another and open at a front side of the container housing, for a pull-out and push-in drawer element, wherein housing modules, which together bound a reception compartment, have a module horizontal wall extending at right angles to the height direction and at least one module side wall projecting in the height direction and integrally formed at the edge of the module horizontal wall and are coupled to one another at their module side walls, wherein at least one or each reception compartment is laterally bounded by a compartment side wall of the container housing, which compartment side wall is composed of an upward-projecting upper module side wall of a lower housing module and a downward-projecting lower module side wall of an upper housing module placed on top of the lower housing module in the height direction, which downward-projecting lower module side wall is coupled to this upper module side wall in a way which prevents lifting-off, and wherein the housing modules comprise a lower housing end module, which is located at the underside of the container housing, and an upper housing end module, which is located at the top side of the container housing, wherein the upper module side wall of the lower housing end module projects upward from the module horizontal wall of the lower housing end module defining a lower end wall and the lower module side wall of the upper housing end module projects downward from the horizontal wall of the upper housing end module defining an upper end wall, wherein the lower housing end module is coupled to the lower module side wall of a housing module placed directly above and the upper housing end module is coupled to the upper module side wall of a housing module placed directly below, and wherein the upper housing end module is a container module, which bounds a storage space accessible through an access opening pointing upwards in the height direction, wherein a container module side wall, which laterally bounds the storage space, projects upwards in the height direction from the edge of the upper end wall away from the lower module side wall.

2. The storage container according to claim 1, wherein the lower housing end module and the upper housing end module are arranged directly on top of each other in the height direction and coupled to each other at their module side walls while jointly bounding a reception compartment.

3. The storage container according to claim 1, wherein the upper housing end module is on its top side bounded by a cover wall spaced from the module horizontal wall of the upper housing end module, on the upward-oriented outside of which a bow-shaped carrying handle is provided.

4. The storage container according to claim 3, wherein the cover wall is directly represented by the upper end wall of the upper housing end module.

5. The storage container according to claim 3, wherein the bow-shaped carrying handle is pivotably arranged on the cover wall.

6. The storage container according to claim 1, wherein the container module has a cover plate spaced from the module horizontal wall of the container module, which alternatively frees or blocks the upward-oriented access opening.

7. The storage container according to claim 6, wherein the cover plate is pivotably mounted on the container module side wall of the container module.

8. The storage container according to claim 1, wherein housing modules, which are arranged immediately adjacent to one another in the height direction are coupled to one another at their facing upper and lower module side walls by latching by means of mutually engaging latching means.

9. The storage container according to claim 8, wherein each upward-projecting upper module side wall has several first latching means and each downward-projecting lower module side wall has a corresponding number of second latching means, which are complementary to the first latching means, wherein the first or the second latching means are designed as latching hooks projecting from the associated module side wall in the height direction and the other latching means comprise a latching edge, which can be engaged from behind by a latching hook.

10. The storage container according to claim 9, wherein the latching edge is assigned to a plug-in receptacle formed in the associated module side wall to accommodate the latching hook.

11. The storage container according to claim 10, wherein the latching edge is represented by the rim of a window-type opening of the respective module side wall which laterally opens into the plug-in receptacle.

12. The storage container according to claim 1, wherein each compartment side wall, apart from a compartment opening of the associated reception compartment provided at the front side of the container housing for access to the drawer element, extends as a closed entity around the associated reception compartment.

13. The storage container according to claim 1, wherein a drawer element is provided in each reception compartment in a pull-out and push-in arrangement.

14. The storage container according to claim 13, wherein the drawer element has a base wall and an upward-projecting outer wall extending around the edge of the base wall, wherein a drawer interior is bounded by the base wall and the outer wall, and wherein a handle is expediently located on the outside, which faces away from the drawer interior, of a front outer wall section of the drawer element.

15. A storage container provided with a modular container housing, which has a plurality of housing modules arranged above one another in a height direction and coupled to one another in pairs in a way which prevents their lifting off from one another and which is provided with at least one reception compartment bounded by two housing modules located directly above one another and open at a front side of the container housing, for a pull-out and push-in drawer element, wherein housing modules, which together bound a reception compartment, have a module horizontal wall extending at right angles to the height direction and at least one module side wall projecting in the height direction and integrally formed at the edge of the module horizontal wall and are coupled to one another at their module side walls, wherein at least one or each reception compartment is laterally bounded by a compartment side wall of the container housing, which compartment side wall is composed of an upward-projecting upper module side wall of a lower housing module and a downward-projecting lower module side wall of an upper housing module placed on top of the lower housing module in the height direction, which downward-projecting lower module side wall is coupled to this upper module side wall in a way which prevents lifting-off, and wherein the upper and lower module side walls of at least two housing modules placed directly on top of one another, which module side walls together form a compartment side wall, have different wall heights, so that they project to different degrees from the associated module horizontal wall in the height direction.

16. The storage container according to claim 15, wherein the housing modules comprise a lower housing end module, which is located at the underside of the container housing, and an upper housing end module, which is located at the top side of the container housing, wherein the upper module side wall of the lower housing end module projects upward from the module horizontal wall of the lower housing end module defining a lower end wall and the lower module side wall of the upper housing end module projects downward from the horizontal wall of the upper housing end module defining an upper end wall, wherein the lower housing end module is coupled to the lower module side wall of a housing module placed directly above and the upper housing end module is coupled to the upper module side wall of a housing module placed directly below.

17. The storage container according to claim 15, wherein the upper module side wall of the lower housing module and the lower module side wall of the upper module housing module together form a compartment side wall, the upward-projecting upper module side wall of the lower housing module being higher than the downward-projecting lower module side wall of the housing module placed directly above.

18. A storage container provided with a modular container housing, which has a plurality of housing modules arranged above one another in a height direction and coupled to one another in pairs in a way which prevents their lifting off from one another and which is provided with at least one reception compartment bounded by two housing modules located directly above one another and open at a front side of the container housing, for a pull-out and push-in drawer element, wherein housing modules, which together bound a reception compartment, have a module horizontal wall extending at right angles to the height direction and at least one module side wall projecting in the height direction and integrally formed at the edge of the module horizontal wall and are coupled to one another at their module side walls, wherein at least one or each reception compartment is laterally bounded by a compartment side wall of the container housing, which compartment side wall is composed of an upward-projecting upper module side wall of a lower housing module and a downward-projecting lower module side wall of an upper housing module placed on top of the lower housing module in the height direction, which downward-projecting lower module side wall is coupled to this upper module side wall in a way which prevents lifting-off, and wherein the container housing comprises several reception compartments, each bounded by two housing modules located immediately on top of each other, for a pull-out and push-in drawer element each, wherein at least one or each housing module located between two reception compartments is designed as a housing intermediate module, which has a module horizontal wall extending transversely to the height direction between the reception compartments as well as an upward-projecting upper module side wall formed integrally at the edge of the module horizontal wall and a lower module side wall formed integrally at the edge of the module horizontal wall and projecting beyond the module horizontal wall in a downward direction, so that the housing intermediate module contributes to the formation of both a compartment side wall, which bounds the reception compartment located above the housing intermediate module, and a compartment side wall, which laterally bounds the reception compartment located below.

* * * * *